US009733594B2

(12) United States Patent
Ishida et al.

(10) Patent No.: US 9,733,594 B2
(45) Date of Patent: Aug. 15, 2017

(54) DEVELOPING DEVICE

(71) Applicant: CANON KABUSHIKI KAISHA, Tokyo (JP)

(72) Inventors: Yusuke Ishida, Toride (JP); Takanori Iida, Noda (JP); Yasushi Takeuchi, Moriya (JP); Toshiyuki Yamada, Kashiwa (JP); Shiro Higashikozono, Tsukuba (JP); Hiroto Kakinuma, Moriya (JP); Toshiya Kobayashi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/232,153

(22) Filed: Aug. 9, 2016

(65) Prior Publication Data

US 2017/0060034 A1 Mar. 2, 2017

(30) Foreign Application Priority Data

Aug. 31, 2015 (JP) ..... 2015-171089

(51) Int. Cl.
*G03G 15/09* (2006.01)
*G03G 15/08* (2006.01)

(52) U.S. Cl.
CPC ..... *G03G 15/0928* (2013.01); *G03G 15/0818* (2013.01)

(58) Field of Classification Search
CPC combination set(s) only.
See application file for complete search history.

(56) References Cited

U.S. PATENT DOCUMENTS 5,153,376 A 10/1992 Tomita
6,026,265 A 2/2000 Kinoshita et al.
9,002,242 B2 4/2015 Ishida
(Continued)

FOREIGN PATENT DOCUMENTS

JP H05-249833 A 9/1993
JP 2001-134069 A 5/2001
(Continued)

OTHER PUBLICATIONS

European Search Report received Jan. 19, 2017, in related European Patent Application No. 16184453.5.

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A developing device includes a developing container, a developing sleeve, a magnet and grooves provided at a surface of the sleeve and formed along a direction crossing a circumferential direction of the sleeve. In a cross-section, each of the grooves is formed by a flat bottom portion contacting a carrier particle and a pair of side surface portions provided in both sides of the flat bottom portion with respect to the circumferential direction of the sleeve and satisfies the following relationship:

$r<w<2r,$ $2\times r<L,$ and $r/2\leq s<2r.$

In the above, r is a volume-average particle size of the carrier particles, w is a length of the flat bottom portion, L is a width (Continued)

between the side surface portions at the surface of the sleeve, and s is a depth of each of the grooves.

23 Claims, 8 Drawing Sheets

(56) References Cited

U.S. PATENT DOCUMENTS

| | | | | |
|---|---|---|---|---|
| 9,235,158 | B2 | 1/2016 | Ishida | |
| 2001/0048827 | A1* | 12/2001 | Okada | B82Y 15/00 399/276 |
| 2006/0204285 | A1* | 9/2006 | Zemba | G03G 15/0921 399/276 |
| 2008/0205942 | A1 | 8/2008 | Toyama et al. | |
| 2015/0253689 | A1 | 9/2015 | Ishida et al. | |
| 2015/0338780 | A1 | 11/2015 | Matsumoto | |
| 2015/0362864 | A1 | 12/2015 | Suzuki | |

FOREIGN PATENT DOCUMENTS

| | | | |
|---|---|---|---|
| JP | 2006-139075 | A | 6/2006 |
| JP | 2011-137868 | A | 7/2011 |
| JP | 2013-190759 | A | 9/2013 |
| JP | 2013-238811 | A | 11/2013 |

* cited by examiner

DEVELOPING DEVICE

FIELD OF THE INVENTION AND RELATED ART

The present invention relates to a developing device for developing an electrostatic latent image, formed on an image bearing member such as a photosensitive drum, with a developer containing a toner and a carrier.

In an image forming apparatus using an electrophotographic type or an electrostatic recording type, the electrostatic latent image formed on the image bearing member such as the photosensitive drum. In the developing device used for such development, one using a two-component developer consisting of the toner and the carrier has been conventionally known.

In such a developing device, the developer is carried on a surface of a developing sleeve in which a magnet is provide, and is fed by rotation of the developing sleeve. An amount (layer thickness) of the developer is regulated by a regulating blade provided closely to the developing sleeve, and then is fed to a developing region. Then, the electrostatic latent image formed on the photosensitive drum is developed with the toner in the developer.

As the developing sleeve for carrying and feeding the developer as described above, one having a plurality of V-shaped grooves in cross-section on a surface thereof has been known (Japanese Laid-Open Patent Application (JP-A) 2013-190759). In the case of such a constitution, the developer is caught by the plurality of grooves provided on the surface and thus can be efficiently fed. Further, as a cross-sectional shape of the grooves, a trapezoidal shape other than the V-shape has also been known (JP-A H5-249833).

In the case of the V-shaped grooves as disclosed in JP-A 2013-190750, there is a possibility that the grooves are clogged with the carrier in the developer. When the grooves are clogged with the carrier, the carrier continuously remains in the grooves, so that a deterioration of the carrier is promoted. As a result, there is a possibility that an image defect due to a lowering in toner charge amount generates and that the surface of the developing sleeve is contaminated with the carrier.

On the other hand, it would be considered that the carrier in the grooves is easily replaced by increasing an angle of the V-shape of each of the grooves and thus it is possible to suppress clogging of the grooves with the carrier. However, when the angle of the groove is increased, the carrier is not readily caught by the grooves, so that a feeding property of the developer by the developing sleeve lowers and thus a coating amount of the developer on the developing sleeve becomes unstable.

Further, as in JP-A H5-249833, in the case where the groove shape is a trapezoidal shape ((upper base width)>(lower base width)>(carrier diameter)), it is possible to suppress the clogging of the grooves with the carrier and a sufficient feeding property can be ensured. However, in the case of the constitution of JP-A H5-249833, each groove has a width corresponding to a plurality of carrier diameters. For this reason, the carrier carried with respect to a widthwise direction of the grooves increases in amount, so that there is a tendency that a feeding force of the developing sleeve is high. Further, when the feeding force by the grooves is excessively high, there is a need to narrow a gap between the developing sleeve and a regulating member for regulating a coating amount of the developing sleeve, so that the gap between the developing sleeve and the regulating member is easily clogged with a foreign matter or the like and thus cause an image defect. Therefore, in order to minimize the feeding force of each groove, it is preferable that the number of carriers carried with respect to the widthwise direction of the groove is 1 at the maximum. However, when an opening width of each groove is decreased, the carrier in the groove is not readily replaced.

SUMMARY OF THE INVENTION

A principal object of the present invention is to provide a developing device capable of reducing a degree of a deterioration of a carrier while suppressing an excess of a feeding force per (one) groove.

According to an aspect of the present invention, there is provided a developing device comprising: a developing container configured to accommodate a developer containing toner and carrier particles; a cylindrical developing sleeve rotatable while carrying the developer in the developing container; a magnet provided in the developing sleeve and configured to generate a magnetic force for holding the developer; and a plurality of grooves provided at a developer carrying surface of the developing sleeve and formed along a direction crossing a circumferential direction of the developing sleeve, wherein in a cross-section perpendicular to a rotational axis of the developing sleeve, each of the grooves is formed by a flat bottom portion contacting the carrier particle and a pair of side surface portions provided in both sides of the flat bottom portion with respect to the circumferential direction of the developing sleeve and satisfies the following relationships:

$$r<w<2r,$$

$$2\times r<L, \text{ and}$$

$$r/2\leq s<2r,$$

where r is a volume-average particle size of the carrier particles, w is a length of the flat bottom portion measured in the cross-section perpendicular to the rotational axis of the developing sleeve, L is a width between the side surface portions at the surface of the developing sleeve in the cross-section perpendicular to the rotational axis of the developing sleeve, and s is a depth of each of the grooves.

Further features of the present invention will become apparent from the following description of exemplary embodiments with reference to the attached drawings.

DESCRIPTION OF THE EMBODIMENTS

First Embodiment

Figure 1:
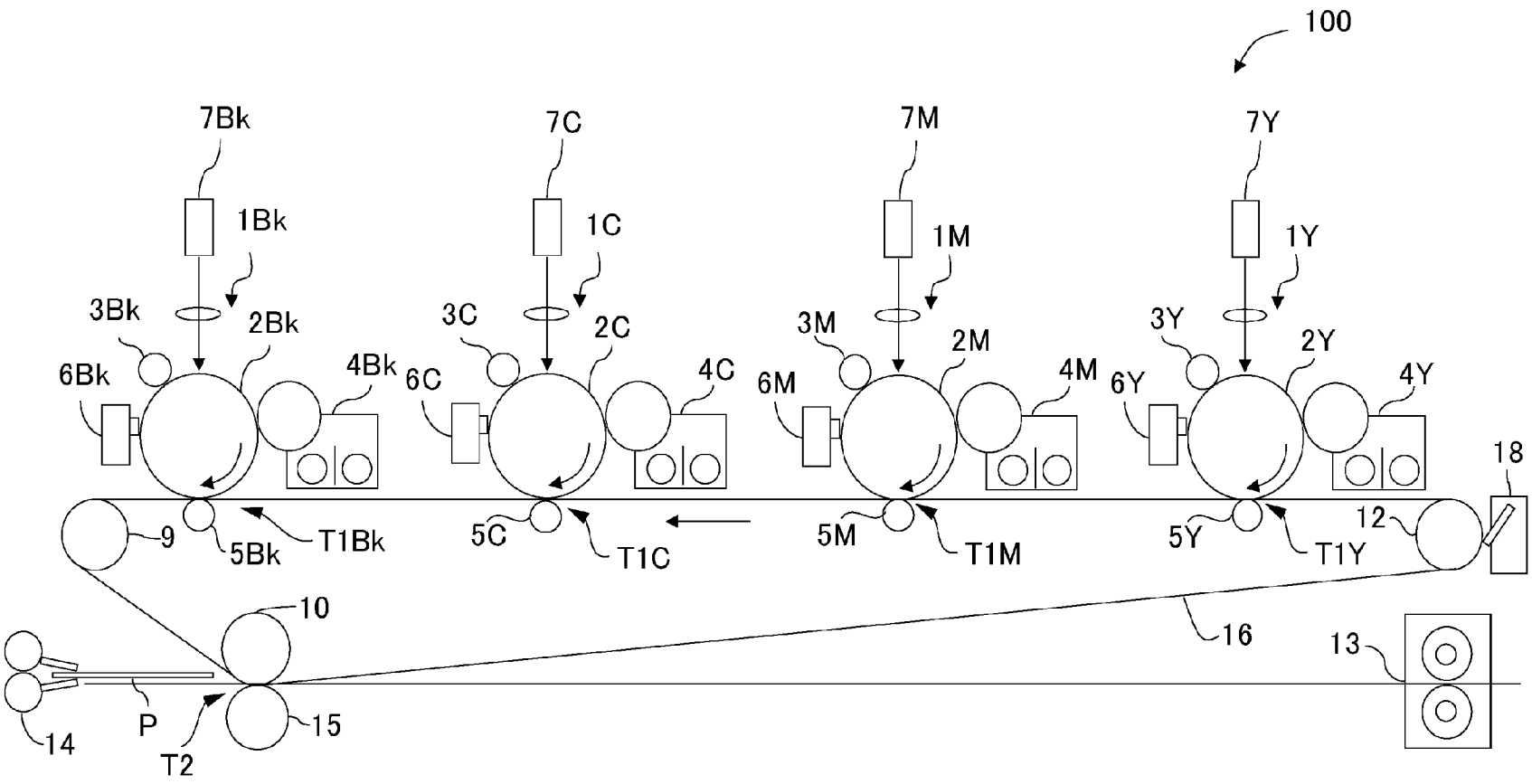
FIG. 1 is a schematic structural view of an image forming apparatus in a First Embodiment.

The First Embodiment of the present invention will be described with reference to FIGS. 1 to 7. First, a schematic structure of an image forming apparatus including a developing device in this embodiment will be described with reference to FIG. 1.

[Image Forming Apparatus]

An image forming apparatus 100 is an electrophotographic full-color printer including four image forming portions (stations) 1Y, 1M, 1C and 1Bk provided correspondingly to four colors of yellow, magenta, cyan and black. The image forming apparatus 100 forms a toner image (image) on a recording material P depending on an image information signal from an original reading device (not shown) connected to an image forming apparatus main assembly or from a host device such as a personal computer communicatably connected to the image forming apparatus main assembly. As the recording material, it is possible to cite a sheet material such as paper, a plastic film, fabric, or the like.

An outline of such an image forming process will be described. First, toner images of respective colors are formed, at the first to fourth image forming portions 1Y, 1M, 1C and 1Bk, on photosensitive drums (electrophotographic photosensitive member) 2Y, 2M, 2C and 2Bk as an image bearing member. The thus-formed toner images of respective colors are transferred onto an intermediary transfer belt 16, and then are transferred from the intermediary transfer belt 16 onto the recording material P. The recording material P on which the toner images are transferred is fed to a fixing device 13, by which the toner images are fixed on the recording material P. This will be described below more specifically.

Incidentally, the four image forming portions 1Y, 1M, 1C and 1Bk have the substantially same constitution except that development colors are different from each other. Therefore, in the following, the image forming portion 1Y will be described as a representative, and other image forming portions 1M, 1C and 1Bk will be omitted from description. At the image forming portion 1Y, a cylindrical photosensitive member as the image bearing member, i.e., the photosensitive drum 2Y, is provided. The photosensitive drum 2Y is rotationally driven in an arrow direction in FIG. 1. Around the photosensitive drum 2Y, a charging roller 3Y as a charging means, a developing device 4Y as a developing means, a primary transfer roller 5Y as a transferring means, and a cleaning device 6Y as a cleaning means are disposed. Above the photosensitive drum 2Y in FIG. 1, a laser scanner 7Y (expose device) as an exposure means is disposed.

Further, the intermediary transfer belt 16 is disposed oppositely to the photosensitive drum 2Y of each of the image forming portions 1Y. The intermediary transfer belt 16 is stretched by a driving roller 9, an inner secondary transfer roller 10 and a stretching between 12, and is circularly moved by the driving roller 9 in the direction indicated by an arrow in FIG. 1.

At a position opposing the photosensitive drum 2Y of each of the image forming portions 1Y via the intermediary transfer belt 16, an outer secondary transfer roller 15 is disposed and constitutes a secondary transfer portion T2 where the toner images are transferred from the intermediary transfer belt 16 onto the recording material P. At a position downstream of the secondary transfer portion T2 with respect to a recording material feeding direction, the fixing device 13 is disposed.

A process for forming, e.g., a four-color based full-color image by the image forming apparatus 100 constitutes as described above will be described. First, when the image forming operation is started, the surface of the rotating photosensitive drum 2Y is uniformly charged by the charging roller 3Y. In this case, a charging bias is applied to the charging roller 3Y from a charging bias power (voltage) source. Then, the photosensitive drum 2Y is exposed to laser light, corresponding to an image signal, emitted from an exposure device 7Y. As a result, the electrostatic latent image depending on the image signal is formed on the photosensitive drum 2Y. The electrostatic latent image formed on each photosensitive drum 2Y is developed with the toner stored in the developing device 4Y, thus being visualized as a visible image.

In this embodiment, a reverse developing method in which the toner is deposited at a light-portion potential portion exposed to the laser light is used.

The toner image formed on the photosensitive drum 2Y is primary-transferred onto the intermediary transfer belt 16 at a primary transfer portion T1 constituted between the photosensitive drum 2Y and the intermediary transfer belt 16 contacting the primary transfer roller 5Y. In this case, a primary transfer bias is applied to the primary transfer roller 5Y. The toner (transfer residual toner) remaining on the surface of the photosensitive drum 2Y after the primary transfer is removed by the cleaning device 6Y.

Such an operation is successively performed at the image forming portions for yellow, cyan, magenta and black, so that the four color toner images are superposed on the intermediary transfer belt 16. Thereafter, the recording material P accommodated in a recording material accommodating cassette (not shown) is fed from a supplying roller 14 to the secondary transfer portion T2 in synchronism with toner image formation timing. The four color toner images on the intermediary transfer belt 16 are then collectively secondary-transferred onto the recording material P by applying a secondary transfer bias to the outer secondary transfer roller 15. The toner remaining on the intermediary transfer belt 16 without being completely transferred onto the recording material P at the secondary transfer portion T2 is removed by an intermediary transfer belt cleaner 18.

Then, the recording material P is fed to the fixing device 13 as a fixing means. Then, by the fixing device 13, the toner on the recording medium P is subjected to heat and pressure to be melted and mixed, so that a full-color image is fixed on the recording material P. Thereafter, the recording material P is discharged to the outside of the image forming apparatus 100. As a result, a series of the image forming process (image forming operation) is ended. Incidentally, by using only a desired image forming portion, it is also possible to form an image of a desired single color or a plurality of colors.

[Developing Device]

Next, using FIG. 2, the developing device 4Y in this embodiment will be described. In this embodiment, as described above all the developing devices for yellow, magenta, cyan and black have the same constitution. The developing device 4Y includes a developing container 108 in which a two-component developer primarily including nonmagnetic toner particles (toner) and magnetic carrier particles (carrier) is accommodated.

The toner contains a binder resin and a coloring agent. If necessary, particles of coloring resin, inclusive of other additives, and coloring particles having external additive such as fine particles of choroidal silica, are externally added to the toner. The toner is negatively chargeable polyester-based resin manufactured by a polymerization method and may preferably be not less than 5 μm and not more than 8 μm in volume-average particle size. The toner having the volume-average particle size of 6.2 μm was used in this embodiment. Incidentally, as the toner, it is also possible to use a wax-containing toner manufactured by a pulverization method or the like.

As for the material for the carrier, particles of metal, the surface of which have been oxidized or have not been oxidized, such as iron, nickel, cobalt, manganese, chrome, rare-earth metals, alloys of these metals, and oxide ferrite are preferably usable. Further, a resin-coated carrier may also be usable. The method of producing these magnetic particles is not particularly limited. A volume-average particle size (average particle size on the basis of a volume distribution basis) of the carrier may be in the range of 20-60 μm, preferably, 30-50 μm. The carrier may be not less than $10^7$ ohm.cm, preferably, not less than $10^8$ ohm.cm, in resistivity. In this embodiment, the carrier with the volume-average particle size of 40 μm and the resistivity of $10^8$ ohm.cm was used. Further, in this embodiment, as a low-specific gravity magnetic carrier, a magnetic carrier manufactured by a polymerization method by mixing a magnetic metal oxide and a non-magnetic metal oxide in a phenolic binder resin is used. A true density of the carrier is 3.6-3.7 $g/cm^3$, and a magnetization (amount) of the carrier is 53 $A.m^2/kg$. An average circularity of the carrier may preferably be about 0.910-0.995 in view of promotion of replacement of the carrier in a groove 200 as described later, and in this embodiment, the average circularity of the carrier was 0.970.

The average particle size (50%-particle size: D50) of the magnetic carrier on the basis of a volume distribution is, e.g., measured in the following manner using a multi-image analyzer (manufactured by Beckman Coulter Inc.).

A particle size distribution was measured by a particle size distribution measuring device of a laser diffraction scattering type ("Microtrac MT3300EX", manufactured by Nikkiso Co., Ltd.). For measurement, a sample supplying machine for identification measurement ("One Shot Dry Sample Conditioner Turbotrac", manufactured by Nikkiso Co., Ltd.) was mounted. A supplying condition of "Turbotrac" was such that a dust collector was used as a vacuum source, an airflow rate was about 33 l/sec, and pressure was 17 kPa. Control is effected automatically by software. As the particle size, the 50%-particle size (D50) which is a cumulative value is obtained. Control and analysis are effected using an attached software (version: 10.3.3-202D). A measuring condition is as follows:

SetZero Time: 10 sec,
Measuring time: 10 sec,
Number of measurements: One,
Particle refractive index: 1.81,
Particle shape: Non-spherical,
Measuring upper limit: 1208 μm,
Measuring lower limit: 0.243 μm, and
Measuring environment: Normal temperature and normal humidity environment (23° C., 50% RH).

The average circularity of the carrier may preferably be a volume-basis average circularity. The volume-basis average circularity is measured in the following manner using the multi-image analyzer (manufactured by Beckman Coulter Inc.). A solution obtained by mixing about 1%-NaCl aqueous solution (50 vol. %) and glycerin (50 vol. %) is used as an electrolytic solution. Here, the NaCl aqueous solution may only be required to be prepared using a first class grade sodium chloride, and may also be, e.g., "ISOTON (registered trademark)-II", manufactured by Coulter Scientific Japan Co., Ltd. Glycerin may only be required to be a special grade reagent or a first class grade reagent. Into the electrolytic solution (about 30 ml), 0.1-1.0 ml of a surfactant (preferably alkyl benzene sulfonate) as a dispersant is added, and then 2-20 mg of a measurement sample is added. The electrolytic solution in which the sample is suspended is subjected to dispersion by an ultrasonic dispersing device for about 1 minute to obtain a dispersion liquid. The circularity is calculated under a measuring condition below using a 200 μm-aperture as an aperture and a lens with a magnification of 20 times:

Average luminance in measuring frame: 220-230,
Measuring frame setting: 300,
Threshold (SH): 50, and
Vinary-converted level: 180.

The electrolytic solution and the dispersion liquid are placed in a glass measuring container so that a content (concentration) of carrier particles in the measuring container is 5-10 vol. %. The mixture (contents) in the measuring container is stirred at a maximum stirring speed. A suction pressure in the measuring container is set at 10 kPa. In the case where the carrier has a large specific gravity and is liable to settle, the measuring time is increased to 15-30 minutes. Further, the measurement is interrupted every 5-10 minutes, and supply of the sample liquid and supply of the mixture solution of the electrolytic solution and the glycerin are made. The number of measuring carrier particles is 2000 (particles). After the measurement is ended, by (system) software, on a particle image screen, removal of an out-of-focus image, agglomerated particle (simultaneous measurement of plural particles) and the like is made.

The circularity is obtained by the following formula:

$$\text{Circularity}=(4\times\text{Area})/(\text{MaxLength}^2\times\pi),$$

where "Area" is a projected are of a binary-converted carrier particle image, and "MaxLength" is a maximum diameter of the carrier particle image.

An inside of a developer container 108 is partitioned into a developing chamber H3 and a stirring chamber 114 by a partition wall 106 extending in a perpendicular direction, and a portion above the partition wall 106 is open. In each of the developing chamber 113 and the stirring chamber 114, the developer is accommodated.

In the developing chamber 113 and the stirring chamber 114, a first stirring screw 111 and a second stirring screw 112 are provided, respectively. The first stirring screw 111 stirs and feeds the developer in the developing chamber 113, and the second stirring screw 112 stirs and feeds the developer in the stirring chamber 114. Further, in a side upstream of the second stirring screw 112 in the stirring chamber 114 with respect to a feeding direction of the second stirring screw 112, the toner is supplied from a toner supplying container (not shown). Then, the supplied toner and the developer which has already been placed in the stirring chamber 114 are stirred and fed to the second stirring screw 112, so that a toner content (concentration) is uniformized.

Figure 2:
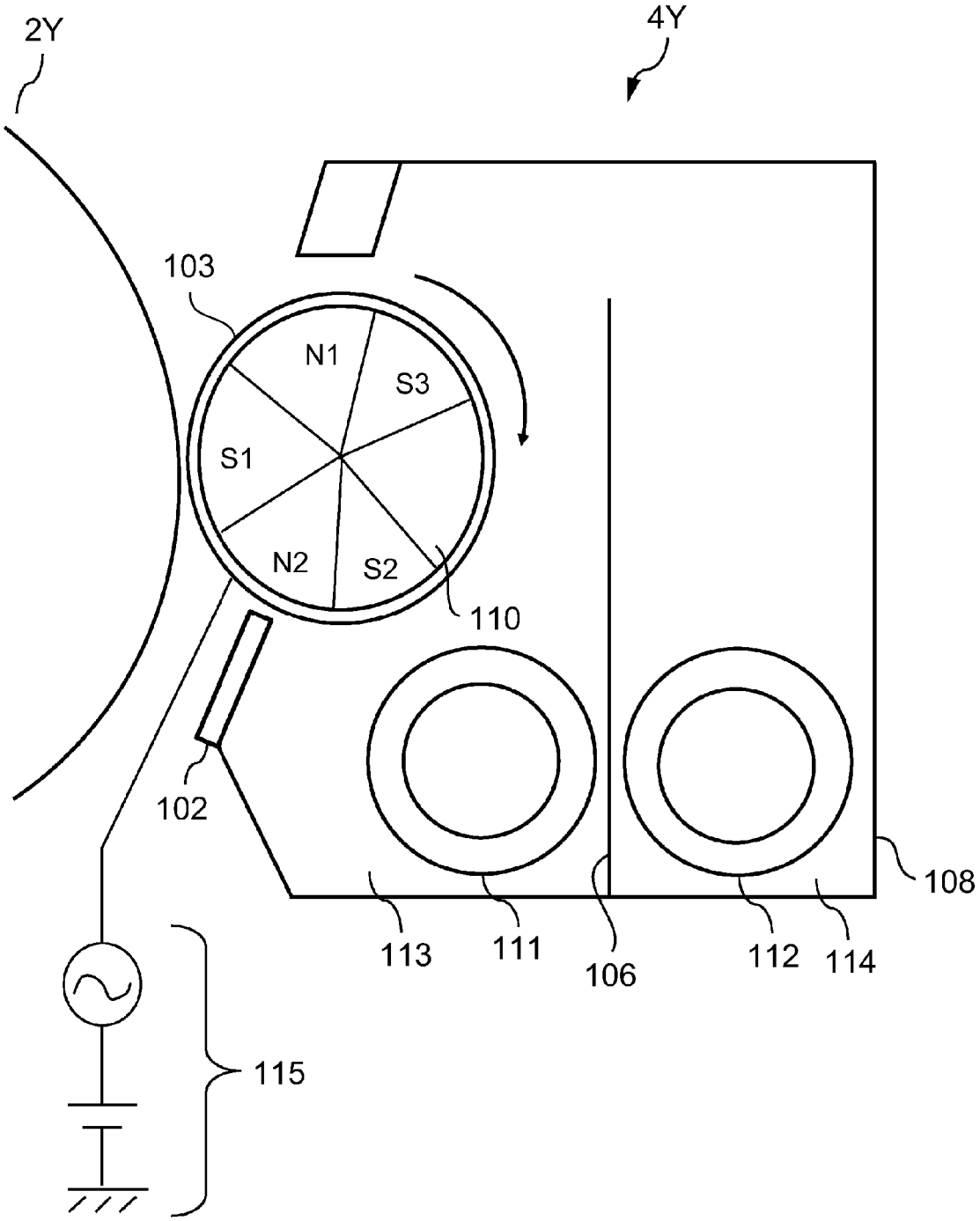
FIG. 2 is a schematic structural view of a developing device according to the First Embodiment.

The partition wall 106 is provided with a developer passage (not shown) for establishing communication between the developing chamber 113 and the stirring chamber 114 at each of end portions in a front side and a rear side thereof in FIG. 2 (i.e., in an upstream side and a downstream side with respect to feeding directions of the first and second stirring screws). Then, the developer is circulated between the developing chamber 113 and the stirring chamber 114 through the developer passages by feeding forces of the first and second stirring screws 111 and 112. As a result, the developer in the developing chamber 113 in which the toner is consumed by the development and thus the toner content lowers is moved into the stirring chamber 114 in which the developer stirred and fed together with the supplied toner in the stirring chamber 114 is moved into the developing chamber 113.

The developing chamber 113 opens at a position corresponding to a region facing the photosensitive drum 2Y, and at this opening, the developing sleeve 103 is rotatably disposed so as to be partly exposed. The developing sleeve 103 is formed in a cylindrical shape by, for example, a non-magnetic material such as an aluminum alloy or stainless steel, and is rotated in an arrow direction indicated in FIG. 2 during a developing operation. Further, inside the developing sleeve 103, a magnet (magnet roller) 110 is fixedly provided, and the developing sleeve 103 is rotated while carrying the developer on its surface by a magnetic field of the magnet 110. Further, at a periphery of the developing sleeve 103, as a developer regulating member, a regulating blade 102 formed of the non-magnetic material such as the aluminum alloy or the stainless steel is provided so that a free end thereof closely opposes a part of a surface of the developing sleeve 103. A predetermined gap is formed between a surface (between grooves) of the developing sleeve 103 and the regulating blade 102. In this embodiment, the gap was 300 μm.

The magnet 110 includes a plurality of fixed magnetic poles. For example, the magnet 110 is constituted by a combination of a plurality of magnet pieces, and is magnetized so that the plurality of magnetic poles S1, S2, S3, N1 and N2 are disposed with respect to a circumferential direction. Here, the S2 pole closest to the first stirring screw 111 is a drawing-up pole where the developer in the developing container (in the developing chamber 113) is drawn up and carried on the developing sleeve 103. The N2 pole positioned adjacent to and downstream of the drawing-up pole (S2) with respect to a rotational direction of the developing sleeve 103 is a cutting pole disposed in the neighborhood of the regulating blade 102 (the regulating member). The S1 pole positioned adjacent to and downstream of the cutting pole (N2) with respect to the rotational direction of the developing sleeve 103 is a developing pole opposing the photosensitive drum 2Y. In a side downstream of the developing pole (S1) with respect to the rotational direction of the developing sleeve 103, the N1 pole and the S3 pole are successively disposed, and the S3 pole is adjacent to the S2 pole via a region where magnetic flux density is low and thus constitutes a repelling pole (peeling-off pole) for peeling the developer off the surface of the developing sleeve 103.

In the case of this embodiment, the plurality of magnetic poles are disposed along the rotational direction of the developing sleeve 103 as described above (5-pole structure), so that the developer in the developing container is carried and fed by the developing sleeve 103. That is, in the developing device 4Y, the developer is stirred and fed by the first and second stirring screws 111 and 112 and thus the toner and the carrier are electrically charged. Then, such a developer is constrained by a magnetic force of a feeding magnetic pole (drawing-pole) S2 for the drawing-up and then is fed by rotation of the developing sleeve 103. In order to stably constrain the developer, the developer is sufficiently constrained by a feeding magnetic pole (cutting pole) N2 having the magnetic flux density to some extent, and then is fed while forming a magnetic brush. Then, the magnetic brush is cut by the regulating blade 102, so that an amount (layer thickness) of the developer is properly controlled.

Then, at the developing pole S1, a developing bias in the form of a DC electric field biased with an AC electric field is applied to the developing sleeve 103 from a power source 115 provided in an image forming apparatus side. As a result, the toner on the developing sleeve 103 is moved to the electrostatic latent image side of the photosensitive drum 2Y, so that the electrostatic latent image is visualized as the toner image. Incidentally, the developing bias is in the form of a DC voltage biased with an AC voltage, and in this embodiment, a rectangular wave of an AC voltage of 10 kHz in frequency and 1000 V in amplitude is used. The developer after the development is ended is fed to the peeling-off pole S3 via an attracting pole N1 and then is taken into the developing container by the peeling-off pole S3.

[Developing Sleeve]

The developing sleeve 103 will be described specifically using FIG. 3. The developing sleeve 103 is a so-called grooved sleeve having a plurality of grooves 200 each formed on the surface thereof with respect to a direction crossing a circumferential direction thereof as shown in (a) of FIG. 3. In this embodiment, the plurality of grooves 200 are formed at substantially the same interval in parallel to a rotational axis direction of the developing sleeve 103. Incidentally, in the case of this embodiment, an outer diameter (on the surface at a portion between the grooves) of the developing sleeve 103 is 200 mm, and the number of the grooves is 100.

Figure 3:
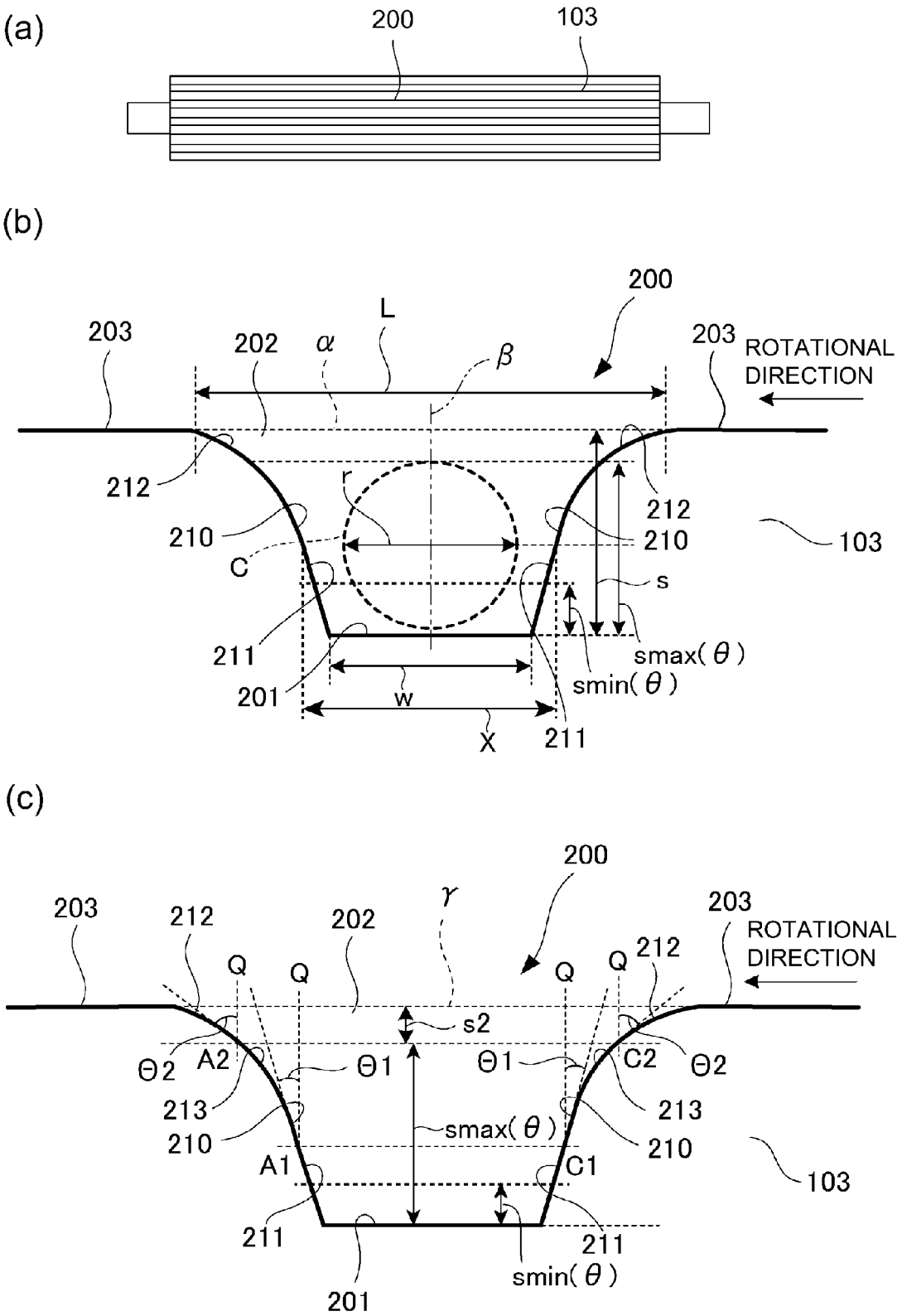
In FIG. 3(*a*) to (*c*) are schematic views of a developing sleeve in the First Embodiment, in which (*a*) is a plan view of the developing device, (*b*) is an enlarged view of a groove, and (*c*) is an enlarged view of the groove for illustrating a structure of the groove.

In FIG. 3(*b*) is an enlarged sectional view of each groove in which a portion of the grooves 200 is cut along a direction perpendicular to the rotational axis direction of the developing sleeve 103. Each of the plurality of grooves 200 includes, as shown in (*b*) of FIG. 3, a bottom portion 201 and a pair of side surface portions 210 provided in both sides of the developing sleeve 103 with respect to the circumferential direction of the developing sleeve 103. Incidentally, each of the bottom portion 201 and the side surface portions 210 described below is a surface corresponding to a locus drawn when each surface is singly scanned with a phantom circle C having a diameter equal to a volume-average particle size r of the carrier. For example, the case where each of the bottom portion 201 and the side surface portions 210 is singly extracted from the drawing of 8*b*) of FIG. 3 will be considered. In this case, when the phantom circle C is contacted to the bottom portion 201 and then is moved from one end to the other end with respect to the widthwise direction of the bottom portion 201, a locus of points of contact of the phantom circle C with the bottom portion 201 is a surface constituting the bottom portion 201. Similarly, when the phantom circle C is contacted to each of the side surface portions 210 and then is moved from a lower end to an upper end of the side surface portion 210, a locus of points of contacts of the phantom circle C with the side surface portion 210 is a surface constituting the side surface portion 210. In other words, a shape of each of the bottom portion 201 and the side surface portions 210 is a macroscopic shape which does not include microscope uneven portion such as a surface roughness portion, for example.

[Bottom Portion of Groove]

The bottom portion 201 is a substantially flat surface. In this embodiment, the bottom portion 201 is a flat surface substantially parallel to a tangential line of a circumscribed circle a of the developing sleeve 103 at a position of a center of the groove 200 with respect to the circumferential direction. Here, the case where the phantom circle C in which the volume-average particle size r of the carrier is a diameter thereof is positioned so that a center thereof is on a phantom line β with respect to a normal direction of the circumscribed circle α passing through the center of the bottom portion 201 and the phantom circle C is disposed so as to contact the bottom portion 201 will be considered. In this case, the bottom portion 201 is the flat surface, and therefore, the phantom circle C contacts the bottom portion 201 at one point (position). Further, when a width of the bottom portion 201 with respect to the circumferential direction of the developing sleeve 103 is w and the volume-average particle size of the carrier is r, the bottom portion 201 is disposed so as to satisfy: $r<w$, more preferably $5r/4 \leq w < 2r$. In this embodiment, the volume-average particle size of the carrier is 40 μm as described above, and the width w of the bottom portion 201 was 60 μm.

[Width and Depth of Opening of Groove]

In the case where a length of a line γ connecting both ends of an opening 202 (i.e., an opening width in an outermost surface side of the developing sleeve 103) is L ((b) of FIG. 3), the groove 200 is formed so as to satisfy: $2r<L$. That is, the width of the opening 202 is made larger than 2×r. In this embodiment, L is 110 mm. In the case of this embodiment, when a depth of the groove 200 (i.e., a distance between a lowest point position of the bottom portion 201 and the line γ connecting the both ends of the opening 202) is s, the relationship: $r/2 \leq 2r$ is satisfied. In this embodiment, s is 50 μm.

[Side Surface Portions of Groove]

Each of the pair of side surface portions 210 is formed so as to rise from an associated one of both ends of the bottom portion 201 toward the opening 202 and is continuous to a portion 203 between the groove 200 and an adjacent groove 200. Further, the pair of side surface portions 210 is formed so that an interval therebetween is broader in the opening 202 side than in the bottom portion 201 side and so as to be line-symmetrical. That is, the pair of side surface portions 210 is formed line-symmetrically with respect to a normal line (identical to the phantom line β) of the circumscribed circle α passing through the position of the center of the groove 200 with respect to the circumferential direction.

Of the pair of side surface portions 210, an upstream-side side surface portion 210 with respect to the rotational direction of the developing sleeve 103 satisfies the following condition when an angle formed between the developing sleeve 103 and a normal Q of the circumscribed circle β is an inclination angle θ (Θ1, Θ2) as shown in (*c*) of FIG. 3. In this embodiment, the pair of side surface portions 210 is formed line-symmetrically, and therefore, each of the side surface portions 210 satisfies the following condition. That is, each side surface portion 210 includes a first region 211 extending from the bottom portion 201 toward the opening 202 of the groove 200. The first region 211 is defined as a region where a steep side portion satisfying θ (Θ1)<45° is formed. The first region (steep side portion) 211 is a region provided at a position where the phantom circle C is contactable to the first region 211 when the phantom circle C having the diameter r enters the groove 200 in a cross-section perpendicular to the rotational axis direction of the developing sleeve 103. That is, the phantom circle C and the first region 211 have a common tangential line.

Further, each side surface portion 210 includes a second region 212 at a position higher than the first region (steep side portion) 211. The second region 212 is defined as a region where an easy slope portion satisfying θ (Θ2)>45° is formed. In this embodiment, the second region (easy slope portion) 212 is a region extending from the opening 202 toward the bottom portion 201. Further, an entirety of each side surface portion 210 is formed so that θ is the same or increases from the bottom portion 201 toward the opening 202. For that reason, a width of the groove 200 (with respect to the circumferential direction of the developing sleeve) is constituted so as to be the same or (monotonically) increases from the bottom portion 201 toward the opening 202 (with a decreasing depth of the groove 200). Incidentally, when a constitution in which the groove width monotonically increases is employed, the angle θ is not necessarily required to monotonically increase.

The first region 211 in this embodiment includes the region 211 where θ is constant. Further, the first region 211 includes a region 213 where θ gradually increases. Further, in the second region 212, θ is constituted so as to gradually increase. Further, the second region 212 is a curved surface which is smoothly continuous to an intermediary portion (non-groove portion) 203.

Incidentally, each of the regions of the side surface portion 210 may also be a flat inclined surface, a curved surface or a combination of the flat inclined surface and the curved surface. In either case, each of the regions may only be required to satisfy the above-described conditions. For example, in the case where the first region 211 is formed by the cross-section, the angle θ of each tangential line of the curved surface with respect to the normal Q may only be required to be less than 45°, and in the case where the second region 212 is formed by the curved surface, the angle θ of each tangential line of the curved surface with respect to the normal Q may only be required to be made larger than 45°. Further, the pair of side surface portions 210 may also be not line-symmetrical, but in this case, the above-described conditions are satisfied at least at the side surface portion 210 in an upstream side with respect to the rotational direction of the developing sleeve 103. However, even when the pair of side surface portions 210 is not line-symmetrical, it is preferable that each of the regions of each of the side surface portions 210 satisfies the above-described condition.

Further, the first region 211 is formed at least at a position where a height from the lowest point position of the bottom portion 201 is smin (θ) or more. Further, the first region 211 may preferably be formed at a position lower than smax (θ) which is the height from the lowest point position of the bottom portion 201 in the case where the inclination angle is θ.

Here, smax (θ) is an upper limit, of the first region 211 when the inclination angle is θ, determined depending on the angle θ of the first region 211 as described later. In this embodiment, smax (θ) is a length (height) of the groove 200 from the lowest point position of the bottom portion 201 to an upper-limit position of the first region 211 with respect to a depth direction of the groove 200. Incidentally, θ of smax (θ) and smin (θ) is the angle of the side surface portion 210 at an associated position with respect to the normal Q.

Further, smin (θ) is a lower limit, of the region where the first region 211 is required, determined depending on the angle θ of the first region 211, and is a length (height) of the groove 200 from the lowest point position of the bottom portion 201 to a lower-limit position of the first region 211 with respect to the depth direction of the groove 200. In this embodiment, smin (θ)=r/2(1−sinθ) is satisfied. When at least a part of the first region 211 is formed in a region equal to or higher than the lower-limit position smin (θ), the carrier is contactable to the first region 211.

For example, in the case where θ is 30°, the lower limit of the first region 211 is r/4. For this reason, when the first region 211 is formed at a position equal to or higher than r/4, the phantom circle C and the first region 211 can contact each other. As a result, at least one carrier particle is contactable to the first region 211. As a result, it is possible to enhance a feeding property of at least one carrier particle.

On the other hand, the upper limit smax (θ) of the first region 211 satisfies: smax (θ)=r+r/2(1−sinΘ). That is, the first region 211 is formed at a position lower than the upper-limit position smax (θ). For example, in the case where θ is 30°, the first region 211 satisfies: smax (30°)=5r/4. That is, in the case where the angle θ of the first region 211 is θ=30°, the first region 211 may only be required to be set at a position lower than 5r/4. Thus, even when the carrier in a second layer enters the groove 200, the carrier in the second layer can be made hardly contactable to the first region 211. For this reason, the carrier in the second layer can be made to hardly be caught by the groove, so that it is possible to promote replacement of the carrier.

From the above, the first region 211 is constituted so as to be formed at least in a region from the lowest point position of the bottom portion 201 to a position equal to or higher than r/2(1−sinθ) with respect to the depth direction of the groove 200. In addition, the first region 211 is constituted so as not to be formed in a region where the height from the lowest point position of the bottom portion 201 is equal to or higher than r+r/2(1−sinθ).

Here, in the cross-section perpendicular to the rotational axis direction of the developing sleeve 103, an interval between the pair of side surface portions 210 at a position of a height of r/2 from the lowest point position of the bottom portion 201 is X. That is, at a downstream side surface portion 210 with respect to the rotational direction of the developing sleeve 103, the position of the height of r/2 from the lowest point position of the bottom portion 201 is A1.

Further, at the upstream side surface portion 210 with respect to the rotational direction of the developing sleeve 103, the position of the height of r/2 from the lowest point position of the bottom portion 201 is C1.

Further, a width of a line connecting A1 and C1 with respect to the circumferential direction of the developing sleeve 103, i.e., the interval between the pair of side surface portions 210 at the positions A1 and C1, is X. In this case, the interval X is made larger than the volume-average particle size r of the carrier (X>r). Further, a distance between the bottom portion 201 and the line connecting A1 and C1 is r/2 (=20 μm). Further, in this embodiment, the angle A1 formed between the side surface portion 210 and the normal Q at the position A1 (C1) is 35°. As a result, a region between the side surface portions of the groove is not clogged with the carrier in the lowermost layer carried in the groove.

Further, in the case where a length of the second region 212 from the opening 202 with respect to the depth direction is s2, the relationship of s×0.1≤s2 is satisfied. In a preferred example, the relationship of s2≤s×0.5 is satisfied. In this embodiment, a region of 5 μm from the line γ connecting both ends of the opening 202 (s2=5 μm) will be considered. That is, an end position of the second region 212 of the downstream side surface portion 210 with respect to the rotational direction of the developing sleeve 103 in the bottom portion 201 side is A2, and an end position of the second region 212 of the upstream side surface portion 210 with respect to the rotational direction of the developing sleeve 103 in the bottom portion 201 side is C2. In this case, the distance s2 between the line γ and a line connecting A2 and C2 is made larger than 5 μm. Further, in this embodiment, the angle Θ2 formed between the normal Q and the side surface portion 210 at a position of 5 μm from the line γ with respect to the depth direction of the groove 200 is 55°.

[Reason for Groove Conditions]

A reason why the conditions of the groove 200 are defined as described above will be described with reference to FIGS. 4 to 7.

[Width w of Bottom Portion]

Figure 4:
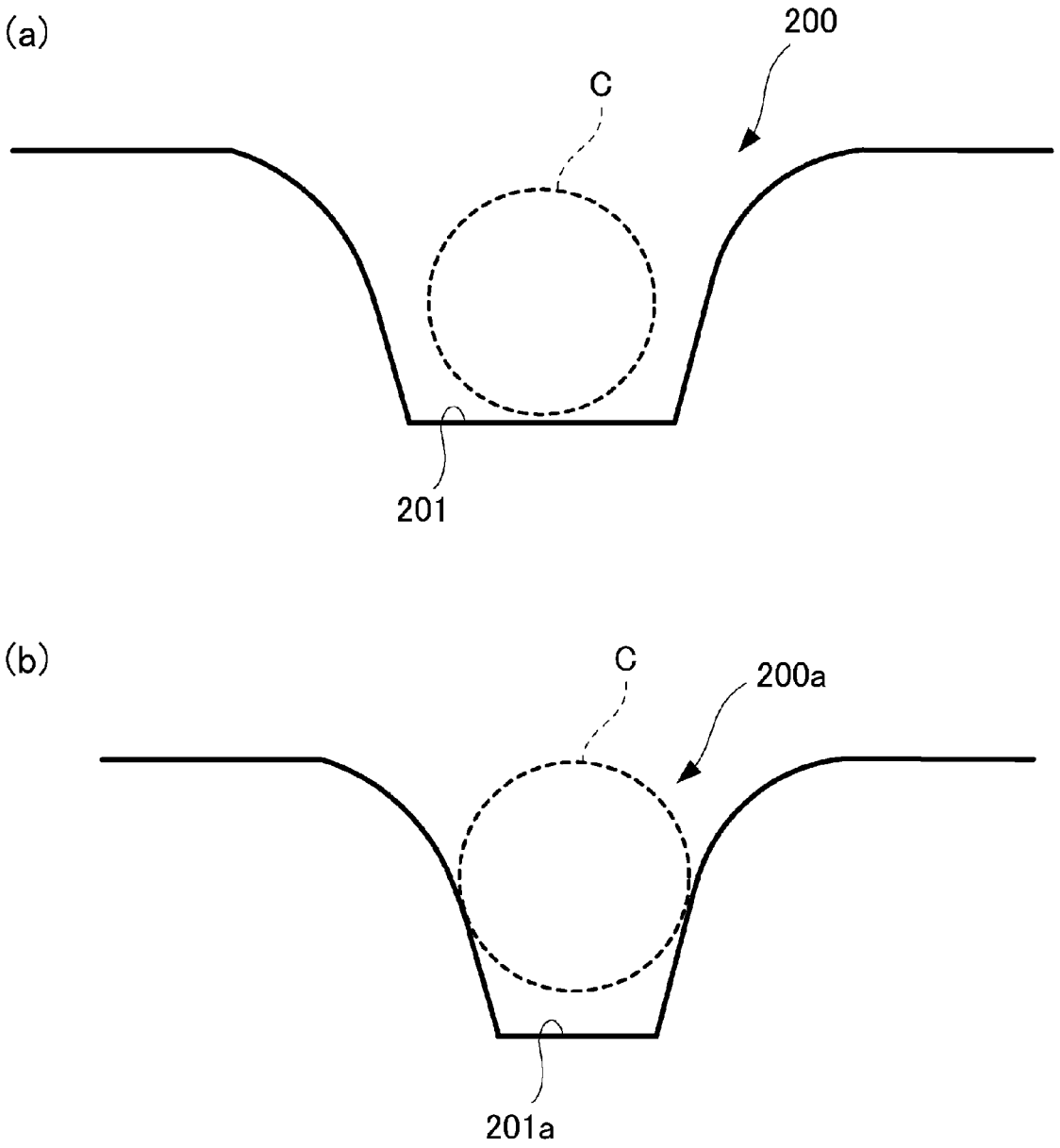
In FIGS. 4(*a*) and (*b*) are schematic views of grooves, in which (*a*) shows the case where a width of a bottom portion of the groove is large, and (*b*) shows the case where a width of a bottom portion of the groove is small as Comparison Example 1.

First, the width w of the bottom portion 201 will be described using FIG. 4. In FIG. 4, (*a*) shows the case where the width w of the bottom portion 201 satisfies r<w, and (b) shows Comparison Example 1 in which the width w of the bottom portion 201 satisfies r<w. As shown in (a) of FIG. 4, in the case where the width w of the bottom portion 201 satisfies r <w, the groove 200 is not readily clogged with the carrier C (identical to the phantom circle C having the diameter equal to the volume-average particle size r). On the other hand, as shown in (b) of FIG. 4, in the case where the width w of the bottom portion 201 satisfies r≥w, the groove 200 is liable to be clogged with the carrier C. For this reason, in this embodiment, the width w of the bottom portion 201 is set to satisfy r<w.

In a preferred example, r<w≤2×r is satisfied. This is because in the case of 2r<w, many carriers (carrier particles) can exist in the groove, and therefore a developer feeding force by the groove is excessively large in some cases. When the developer feeding force by the groove is large, an amount of the developer on the developing sleeve 103 becomes excessive, so that contamination of the image with the toner is liable to generate. Further, in the case where the amount of the developer on the developing sleeve 103 is made proper by setting a gap between the developing sleeve 103 and the regulating blade 102 so as to be narrow (small), the gap is clogged with a foreign matter in some cases. Further, when the groove interval is excessively increased (broadened) by decreasing the number of grooves in order to suppress the feeding property, groove pitch non-uniformity is liable to become conspicuous. For this reason, the width w of the bottom portion 201 may preferably satisfy r<w≤2r.

[Width of Opening]

Figure 5:
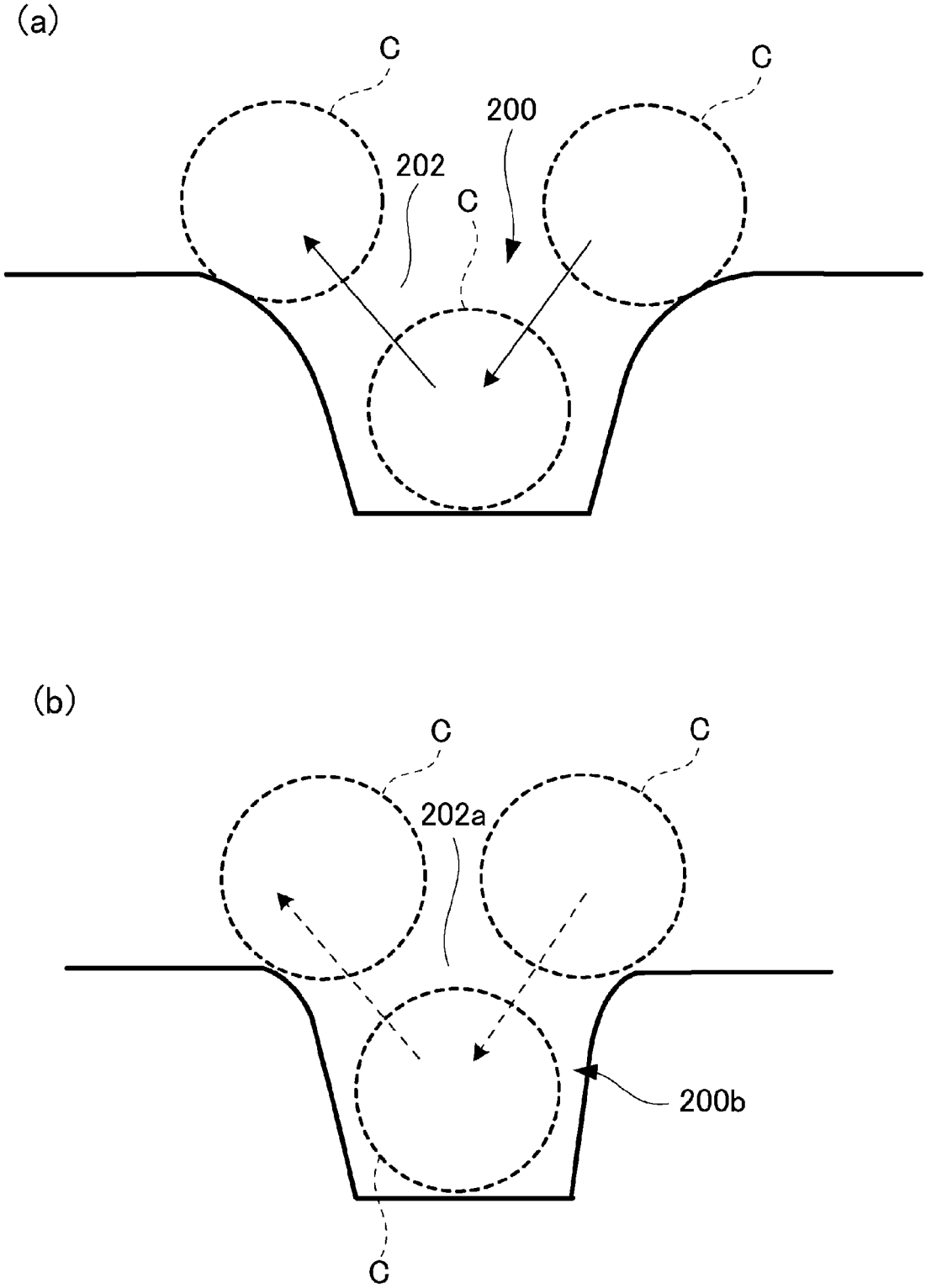
In FIGS. 5(*a*) and (*b*) are schematic views of grooves, in which (*a*) shows the case where a width of a bottom portion of the groove is large, and (*b*) shows the case where a width of a bottom portion of the groove is small as Comparison Example 2.

The width L of the opening 202 will be described using FIG. 5. In FIG. 5, (*a*) shows the case where the width L of the opening 202 satisfies 2×r<L, and (b) shows Comparison Example 2 in which the width L of the opening 202 satisfies 2×r≥L. As shown in (a) of FIG. 5, L of the opening 202 satisfies 2×r<L, so that the carrier existing in the groove 200 moves easily and thus the same carrier C does not readily remain in the groove 200. On the other hand, as shown in (b) of FIG. 5, in the case where the width L is the opening 202 satisfies L≤2r, the carrier C easily remain in the groove 200. For this reason, in this embodiment, the width L of the opening 202 is set to satisfy 2×r<L.

In a preferred example, 2×r<L<3×r is satisfied. This is because in the case of 3×r≤L, many carriers (carrier particles) can exist in the groove due to an increase in width L of the opening 202, and therefore a developer feeding force by the groove is excessively large in some cases. In this case, as described above, an amount of the developer on the developing sleeve 103 becomes excessive, so that contamination of the image with the toner is liable to generate. For this reason, the width L of the opening 202 may preferably satisfy 2×r<L<3×r.

[Groove Width at Upper End Portion of First Region]

In this embodiment, the groove width (with respect to the circumferential direction of the developing sleeve) at the upper end position of the first region is made larger than r and is made smaller than 2r. As a result, the number of carriers (carrier particles) carried and fed between the first regions closely relating to the feeding property can be made one (particle) at the most with respect to the circumferential direction of the developing sleeve.

[Depth of Groove]

Figure 6:
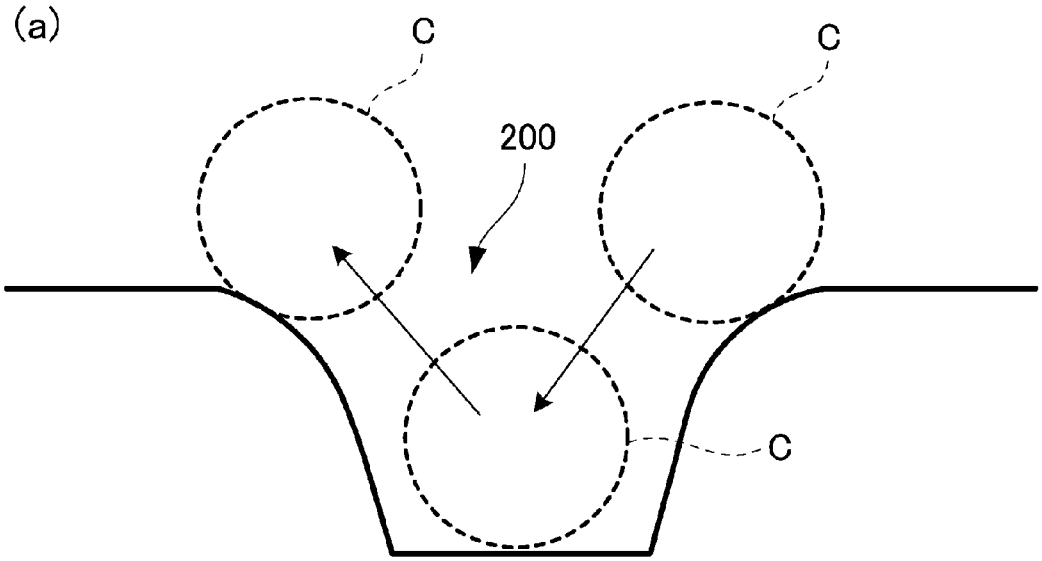
In FIGS. 6(*a*) and (*b*) are schematic views of grooves, in which (*a*) shows the case where a depth of the groove is small, and (*b*) shows the case where a depth of the groove is large as Comparison Example 3.
Figure 6:
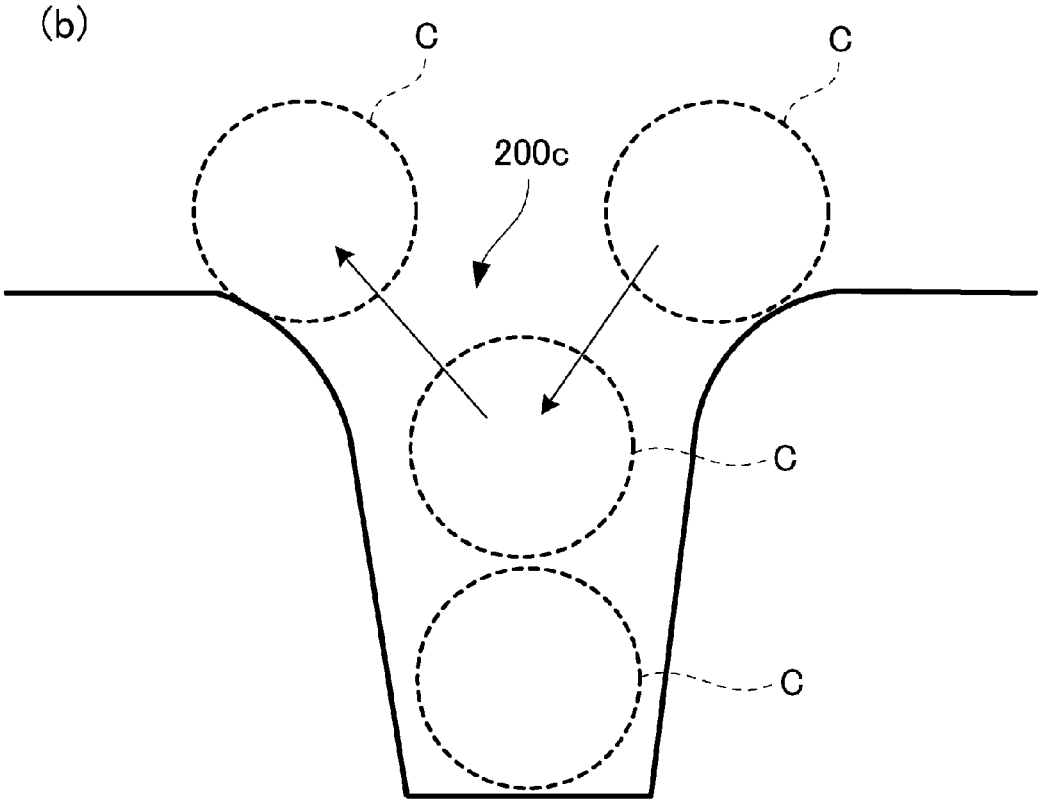

The depth s of the groove 200 will be described using FIG. 6. In FIG. 6(*a*) shows the case where the depth s of the groove 200 satisfies s<2×v, and (b) shows Comparison Example 3 in which the depth s satisfies s≥2×r. As shown in (*a*) of FIG. 5, the depth s of the groove 200 satisfies s<2×r, so that the carrier existing in the groove 200 moves easily and thus the same carrier C does not readily remain in the groove 200. On the other hand, as shown in (*b*) of FIG. 6, in the case where the depth s of the groove 200*c* satisfies 2×r≤s, the carrier C easily remains in the groove 200*c*. For this reason, in this embodiment, the depth s of the groove 200 is set to satisfy s<2×r.

Further, in this embodiment, r/2≤s×r is satisfied. This is because in the case of s<r/2, the carrier feeding force by the groove lowers and thus the amount of the developer on the developing sleeve 103 becomes unstable in some cases. For this reason, the depth s of the groove 200 may preferably satisfy r/2≤2<2×r, more preferably satisfy s<1.5×r. As a result, when the carrier in the second layer reaches on the carrier in the lowermost layer carried by the groove, the carrier in the second layer can be made to hardly be caught by the groove. As a result, a replacing property of the carrier in the lowermost layer can be improved.

[Depth of First Region (Upper End Height of First Region]

In this embodiment, the first region is constituted so as to satisfy: (upper end height of first region)<r+r/2(1−sinθ). As a result, in the first region where the carrier is readily caught by the groove, only the carrier in the lowermost layer can exist. For this reason, it is possible to suppress an excessive increase in feeding property per (one) groove.

The first region (steep side portion) 211 and the second region (easy slope portion) 212 of the groove 200 will be described.

[First Region (Steep Side Portion)]

First, the first region 211 will be described. In this embodiment, the angle θ (Θ1) formed between a groove side surface and a developing sleeve normal direction in the neighborhood of a position of contact of the lowermost layer carrier carried by the groove with the groove side surface is Θ1<45°. In this case, it is possible to ensure a force of constraint of the carrier by the groove 200 in the bottom portion 201 side, and therefore the carrier feeding force by the groove can be stabilized. On the other hand, the case where the angle θ (Θ1) formed between the groove side surface and the developing sleeve normal direction in the neighborhood of the position of contact of the lowest layer carrier carried by the groove with the groove side surface is 45°≤Θ1 will be considered. In this case, the carrier does not remain in the groove but slides and the carrier feeding force by the groove lowers, so that there is a possibility that the amount of the developer on the developing sleeve 103 becomes unstable. Therefore, in this embodiment, the angle θ (Θ1) formed between the groove side surface and the developing sleeve normal direction in the neighborhood of the position of contact of the lowest layer carrier carried by the groove with the groove side surface is made smaller than 45°.

In a preferred example, 20°≤Θ1<45° is satisfied. This is because in the case of Θ1<20°, the carrier is liable to remain in the groove, so that replacement of the carrier existing in the groove does not smoothly progress in some cases.

Further, in this embodiment, as described above, at least a part of the first region 211 is formed so that the inclination angle is not below the lower limit smin (θ) set depending on θ. That is, at least the part of the first region 211 where the inclination angle is θ is constituted so as to be positioned in a range of not less than smin (θ)=r/2(1−sinθ) from the bottom portion 261 with respect to the depth direction. Further, as described above, at least the part of the first region 211 is formed so that the inclination angle does not reach the upper limit smax (θ) set depending on θ. That is, the first region 211 where the inclination angle is θ is constituted so as not to exceed r+r/2(1−sin θ) from the bottom portion 201. Thus, the first region where θ=Θ1<45° occupies a region corresponding to not less than r/2(1−sinθ) from the bottom portion 201, so that the feeding property of the lowermost layer carrier by the groove can be further stabilized. Further, the first region where θ=Θ1<45° is in a position less than r+r/2(1−sin θ) from the bottom portion 201, so that the carriers (carrier particles) in the second and upper layers can be made caught hardly by the groove and thus replacement of the carrier in the lowermost layer can be promoted.

Incidentally, in this embodiment, the distance from the bottom portion 201 to the upper end position of the first region 211 with respect to the groove depth direction may preferably be r/2 or more and less than 3r/2, more preferably r or more and 3r/2. As a result, an effect of causing the carriers in the second and upper layers not to be readily caught by the groove while further stabilizing the feeding property of the lowermost layer carrier by the groove can be obtained.

[Second Region (Easy Slope Portion)]

Figure 7:
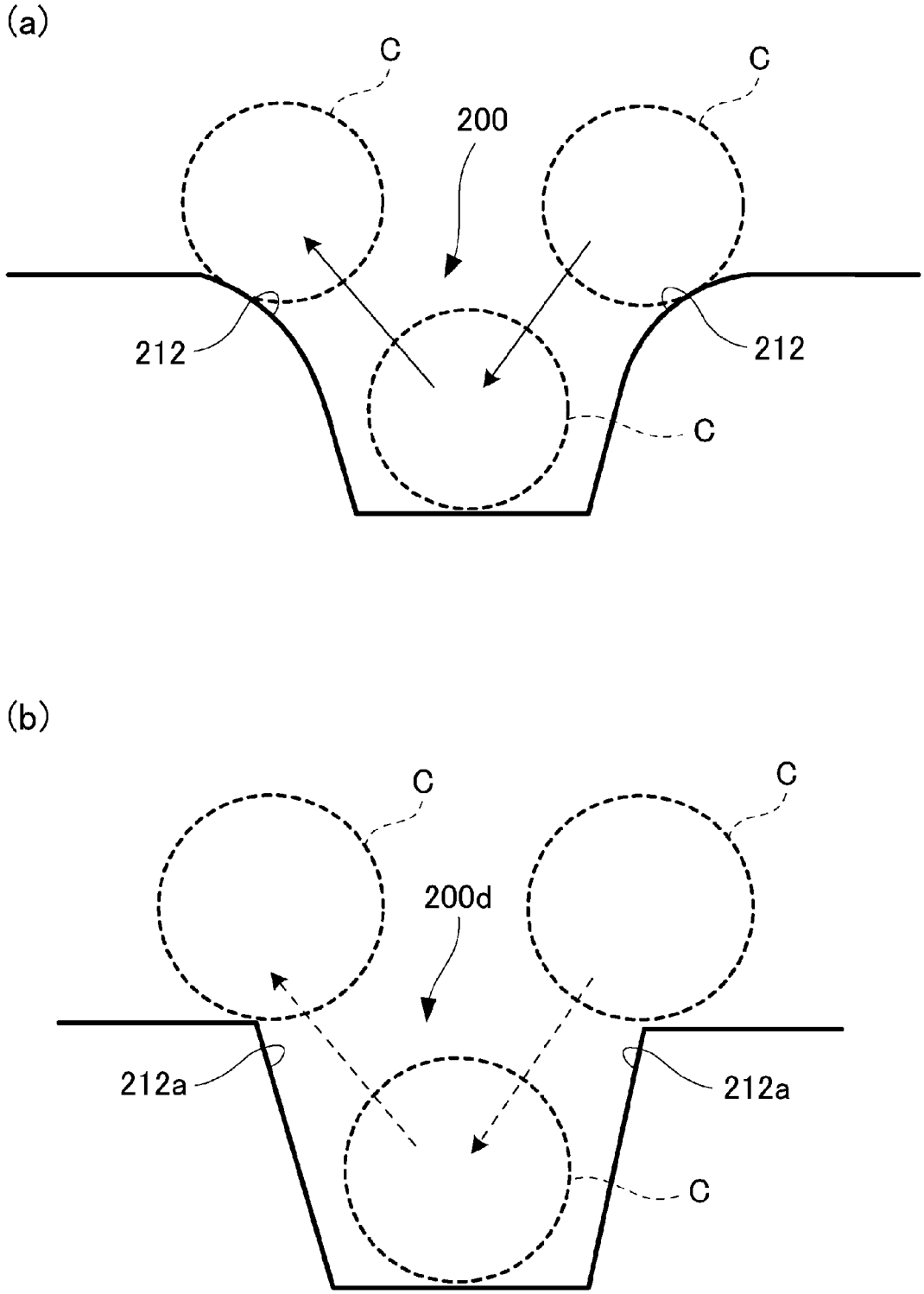
In FIGS. 7(*a*) and (*b*) are schematic views of grooves, in which (*a*) shows the case where inclination of a side surface portion of the groove in an opening side is large, and (*b*) shows the case where inclination of a side surface portion of the groove in an opening side is small as Comparison Example 4.

Next, the second region 212 will be described using FIG. 7. In FIG. 7, (*a*) shows the case where the inclination angle θ (Θ2) of the groove in the neighborhood of the developing sleeve surface layer satisfies Θ2>45°, and (b) shows Comparison Example 4 in which the inclination angle θ(Θ2) of the groove in the neighborhood of the developing sleeve surface layer satisfies Θ2<45°. As shown in (a) of FIG. 7, in the case where the inclination angle Θ2 of the groove in the neighborhood of the developing sleeve surface layer satisfies Θ2>45°, a fresh carrier C easily enters the groove 200, and in addition, the carrier C which has existed in the groove 200 easily goes to an outside. For this reason, it is possible to promote replacement of the carrier existing in the groove 200. On the other hand, as shown in (*b*) of FIG. 4, the inclination angle Θ2 of the groove in the neighborhood of the developing sleeve surface layer satisfies Θ2≤45°, the carrier C which has existed in the groove 200*d* does not readily go to the outside, so that the carrier C remains in the groove 200*d* for a long term. As a result, deterioration of the carrier is promoted. For this reason, in this embodiment, the inclination angle Θ2 of the groove in the neighborhood of the developing sleeve surface layer is set to satisfy Θ2>45°.

In a preferred example, in the second region 212 (in the neighborhood of the developing sleeve surface layer in the groove), 45°<Θ2<80° is satisfied. This is because in the case of 80°<Θ2, the replacement of the carrier existing in the groove 200 rather does not smoothly progress in some cases.

Further, in this embodiment, in the second region 212, in the case where the length from the opening 202 of the second region 212 with respect to the depth direction of the groove 200 is s2, s×0.1≤s2 is satisfied. That is, the side surface portion 210 may preferably satisfy Θ1>45° at least in a region from the opening 202 to a position of 0.1×s from the opening 202 (in this embodiment, a region from the opening 202 to a position of 5 μm from the opening 202). This is because in the case of s×0.1>s2, the replacement of the carrier existing in the groove does not smoothly progress in some cases.

[Experiment]

Here, the following experiment was conducted using the developing sleeves described in the First Embodiment ((b) of FIG. 3), Comparison Example 1 ((b) of FIG. 4), Comparison Example 2 ((b) of FIG. 5), Comparison Example 3 ((b) of FIG. 6) and Comparison Example 4 ((b) of FIG. 7). Specifically, each of such developing sleeves was incorporated in the image forming apparatus as shown in FIG. 1, and then images were continuously formed on A4-sized sheets. Then, a state of toner fog was checked. The toner fog is a phenomenon such that the toner is deposited on also a region other than a region corresponding to the latent image. For example, when a toner charge amount is low, the toner is liable to be deposited on the region other than the latent image region, i.e., the toner fog is liable to occur. Then, when the toner fog occurs, the toner fog is transferred onto the sheet and results in an image defect in some cases.

In the case where the developing sleeve in the First Embodiment was used, the toner fog was at a tolerable level even in the case where the image formation was effected on 1,000,000 A4-sized sheets. On the other hand, in the case where the developing sleeves in Comparison Examples 1 to 4 were used, the toner fog was at an intolerable level at the time of the image formation on 500,000 A4-sized sheets to 700,000 A4-sized sheets. This is because the carrier remaining in the groove was continuously subjected to shearing and deterioration thereof progressed and thus toner charging power thereof lowered.

As described above, in this embodiment, the groove 200 of the developing sleeve is shaped so that the opening width L of the groove 200 satisfies 2r>L and the groove depth s satisfies r/2≤2<2r. Further, the inclination angle θ of the side surface portion 210 is set to satisfy θ<45° in the first region 211 in the bottom portion 201 side and to satisfy 45°<θ in the second region 212 in the opening 202 side. As a result, it is possible to smoothly replace the developer existing in the groove 200 without lowering the developer feeding force. As a result, it is possible to provide the image forming apparatus capable of effecting stable image formation for a long term.

Further, in the case of this embodiment, realization of both of ensuring of the developer feeding property and suppression of carrier deterioration can be inexpensively achieved without upsizing the developing sleeve as described above. For example, as in the above-described JP-A 2013-190759, in the constitution using the device having the V-shaped grooves, it would be considered that not only the angle of the V-shaped groove increases but also the groove depth increases. However, when the groove angle is increased, the carrier existing in the groove is not readily caught by the groove, so that the developer feeding property lowers. Further, in the case where the groove depth is increased, there is a need to increase a thickness of the developing sleeve, so that the developing sleeve is not only upsized but also increased in manufacturing cost. On the other hand, as in this embodiment, the shape of the groove 200 of the developing sleeve is defined as described above, so that it is possible to achieve the realization of both of the ensuring of the developer feeding property and the suppression of the carrier deterioration without upsizing the developing sleeve.

Second Embodiment

A Second Embodiment will be described using FIG. 8. In the above-described First Embodiment, the bottom portion 201 of the groove 200 of the developing sleeve 103 was the flat surface. On the other hand, in this embodiment, a bottom portion 301 of a groove 300 of a developing sleeve 103A is a cross-section. Constitutions other than a constitution of the groove 300 are the same as those in the First Embodiment and therefore explanation and illustration of the same constitutions are omitted or briefly made. In the following, a portion different from the First Embodiment will be principally described.

Figure 8:
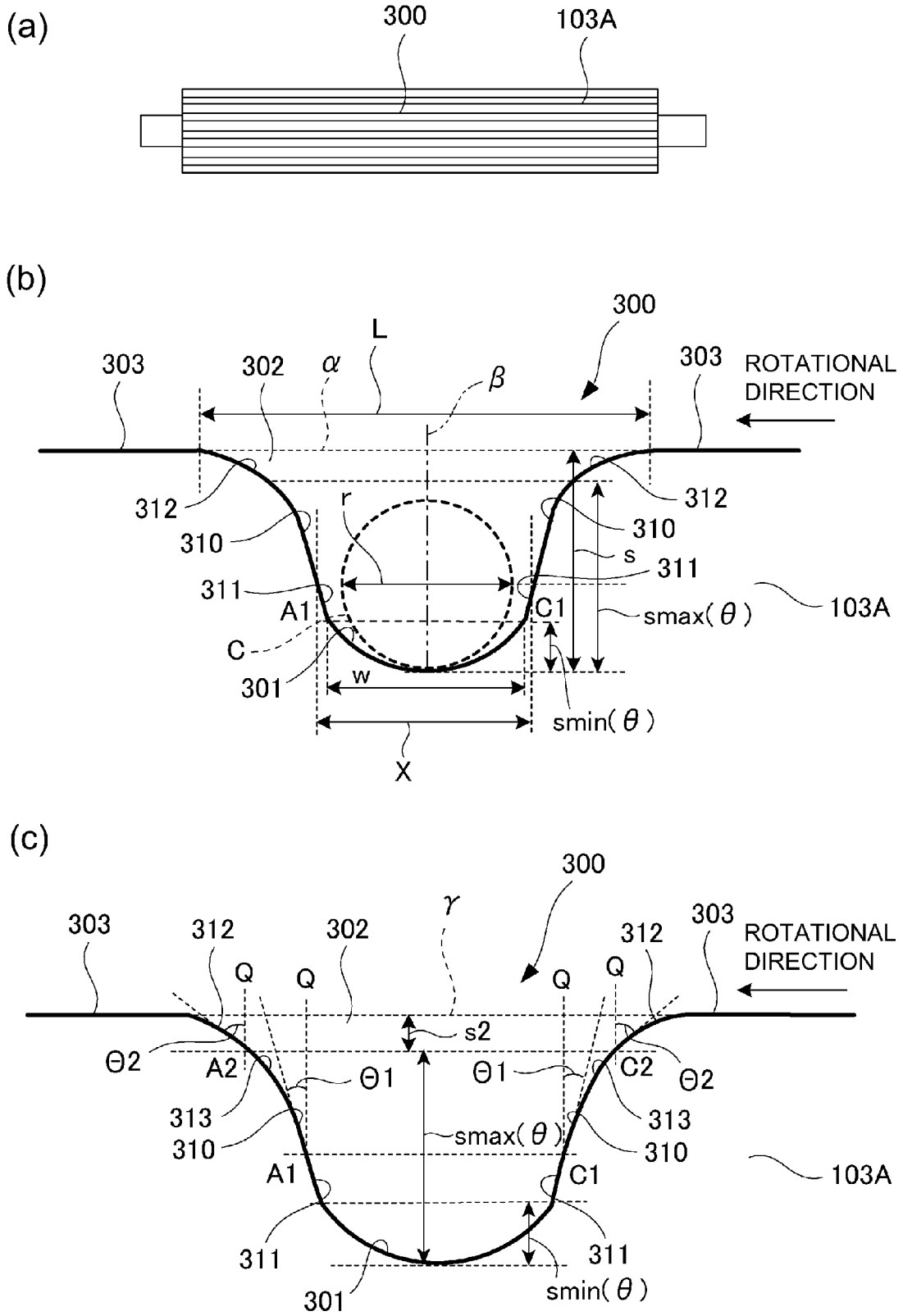
In FIG. 8(*a*) to (*c*) are schematic views of a developing sleeve in a Second Embodiment, in which (*a*) is a plan view of the developing sleeve, (*b*) is an enlarged view of a groove, and (*c*) is an enlarged view of the groove for illustrating a structure of the groove.

The developing sleeve 103A in this embodiment is a so-called grooved sleeve having a plurality of grooves 200 each formed on the surface thereof with respect to a direction crossing a circumferential direction thereof as shown in (a) of FIG. 8. Also in this embodiment, the plurality of grooves 300 are formed at substantially the same interval in parallel to a rotational axis direction of the developing sleeve 103A. Incidentally, also in the case of this embodiment, an outer diameter (on the surface at a portion between the grooves) of the developing sleeve 103A is 200 mm, and the number of the grooves is 100.

In FIG. 8(*b*) is an enlarged sectional view of each groove in which a portion of the grooves 300 is cut along a direction perpendicular to the rotational axis direction of the developing sleeve 103A. Each of the plurality of grooves 300 includes, as shown in (*b*) of FIG. 8, a bottom portion 301 and a pair of side surface portions 310 provided in both sides of the developing sleeve 303 with respect to the circumferential direction of the developing sleeve 103A. Also each of the bottom portion 301 and the side surface portions 310, similarly as in the First Embodiment, a surface corresponding to a locus drawn when each surface is singly scanned with a phantom circle C having a diameter equal to an average particle size r of the carrier.

[Bottom Portion of Groove]

The bottom portion 301 is a curved surface (arc) such that a shape of a cross-section perpendicular to the rotational axis direction of the developing sleeve 103A is recessed inwardly in a radial direction of the developing sleeve 103A. In this embodiment, a radius of curvature of the cross-section as the bottom portion 301 is larger than r/2. Incidentally, r is the volume-average particle size of the carrier. Here, the case where the phantom circle C in which the volume-average particle size r of the carrier is a diameter thereof is positioned so that a center thereof is on a phantom line β with respect to a normal direction of the circumscribed circle α of the developing sleeve 103A passing through the center of the bottom portion 301 and the phantom circle C is disposed so as to contact the bottom portion 301 will be considered.

In this case, the bottom portion 301 is formed so that the phantom circle C contacts the bottom portion 301 at one point (position). Further, when a width of the bottom portion 301 with respect to the circumferential direction of the developing sleeve 103A is w and the volume-average particle size of the carrier is r, the bottom portion 201 is disposed so as to satisfy: $r<w$. Here, in this embodiment, w is a length of a chord of the curved surface (arc). Further, each of both end positions of the bottom portion 301 with respect to the widthwise direction is a lowest point position of a first region 311 described later. That is, at a portion lower than the first region 311 (in a lowest point position side of the bottom portion 301), a range in which an angle θ formed with respect to the normal Q to the circumscribed circle α of the developing sleeve 103A satisfies $\theta>45°$ is the bottom portion 301. The angle formed with respect to the normal Q refers to an angle formed between a tangential (line) direction of the curved surface of the bottom portion 301 and the normal Q in a cross-section perpendicular to the rotational axis direction of the developing sleeve 103A. A width w of the bottom portion 301 may preferably satisfy: $r<w\leq 2r$ similarly as in First Embodiment. That is, in this embodiment, the carrier existing at a bottommost portion of the developing sleeve 301A is prevented from having a point of contact with the groove 300 at a portion other than the bottommost portion.

[Width and Depth of Opening of Groove]

In the case where a length of a line γ connecting both ends of an opening 302 (i.e., an opening width in an outermost surface side of the developing sleeve 103) is L ((b) of FIG. 8), the groove 300 is formed so as to satisfy: $2r<L$. That is, the width of the opening 302 is made larger than 2×r. In this embodiment, L is 110 mm. The width of the opening 302 may preferably be $2\times r<L\leq 3\times r$ similarly as in the First Embodiment.

Also in the case of this embodiment, when a depth of the groove 300 (i.e., a distance between a deepest position (lowest point position) of the bottom portion 201 and the line γ connecting the both ends of the opening 302) is s, the relationship: $r/2\leq 2r$ is satisfied. In a preferred example, $s<1.5\times r$ is satisfied. In this embodiment, the volume-average particle size of the carrier is 40 μm as described above, and s is 50 μm.

[Side Surface Portions of Groove]

Each of the pair of side surface portions 310 is formed so as to rise from an associated one of both ends of the bottom portion 301 toward the opening 302 and is continuous to a portion 303 between the groove 300 and an adjacent groove 300. Further, the pair of side surface portions 310 is formed so that an interval therebetween is broader in the opening 302 side than in the bottom portion 301 side and so as to be line-symmetrical. That is, the pair of side surface portions 310 is formed line-symmetrically with respect to a normal line (identical to the phantom line β) of the circumscribed circle α passing through the position of the center of the groove 300 with respect to the circumferential direction.

Of the pair of side surface portions 310, an upstream-side side surface portion 210 with respect to the rotational direction of the developing sleeve 103A satisfies the following condition when an angle formed between the developing sleeve 103A and a normal Q of the circumscribed circle α is an inclination angle θ (Θ1, Θ2) as shown in (c) of FIG. 8. In this embodiment, the pair of side surface portions 310 is formed line-symmetrically, and therefore, each of the side surface portions 310 satisfies the following condition. That is, each side surface portion 310 includes a first region 311 extending from the bottom portion 201 toward the opening 302 of the groove 300. The first region 311 is defined as a region where a steep side portion satisfying θ (Θ1)<45° is formed. The first region (steep side portion) 311 is a region provided at a position where the phantom circle C is contactable to the first region 311 when the phantom circle C having the diameter r enters the groove 300 in a cross-section perpendicular to the rotational axis direction of the developing sleeve 103A. That is, the phantom circle C and the first region 211 has a common tangential line.

Further, each side surface portion 310 includes a second region 312 at a position higher than the first region (steep side portion) 311. The second region 312 is defined as a region where an easy slope portion satisfying θ (Θ2)>45° is formed. In this embodiment, the second region (easy slope portion) 312 is a region extending from the opening 302 toward the bottom portion 301. Further, an entirety of each side surface portion 310 is formed so that θ is the same or increases from the bottom portion 301 toward the opening 302. For that reason, a width of the groove 300 (with respect to the circumferential direction of the developing sleeve) is constituted so as to be the same or (monotonically) increases from the bottom portion 301 toward the opening 302 (with a decreasing depth of the groove 300). Incidentally, when a constitution in which the groove width monotonically increases is employed, the angle θ is not necessarily required to monotonically increase. Further, similarly as in the First Embodiment, the angle Θ1 of the first region 311 may preferably satisfy: $20°\leq\Theta 1<45°$, and the angle Θ2 of the second region 312 may preferably satisfy: $45°<\Theta 2\leq 80°$.

In this embodiment, the first region 311 includes the region 311 where θ is constant. Further, the first region 311 includes a region 313 where θ gradually increases toward the second region 312. Further, the second region 312 is a curved surface which is smoothly continuous to an intermediary portion (non-groove portion) 303.

Incidentally, each of the regions of the side surface portion 310 may also be a flat inclined surface, a curved surface or a combination of the flat inclined surface and the curved surface. In either case, each of the regions may only be required to satisfy the above-described conditions. For example, in the case where the first region 311 is formed by the cross-section, the angle θ of each tangential line of the curved surface with respect to the normal Q may only be required to be less than 45°, and in the case where the second region 312 is formed by the curved surface, the angle θ of each tangential line of the curved surface with respect to the normal Q may only be required to be made larger than 45°. Further, the pair of side surface portions 310 may also be not line-symmetrical, but in this case, the above-described conditions are satisfied at least at the side surface portion 310 in an upstream side with respect to the rotational direction of the developing sleeve 103A. However, even when the pair of side surface portions 310 is not line-symmetrical, it is preferable that each of the regions of each of the side surface portions 310 satisfies the above-described condition.

Further, the first region 311 is formed at least at a position where a height from the lowest point position of the bottom portion 301 is smin (θ) or more. Further, the first region 311 may preferably be formed at a position lower than smax (θ) which is the height from the lowest point position of the bottom portion 301 in the case where the inclination angle is θ.

Here, smax (θ) is an upper limit, of the first region 311 when the inclination angle is θ, determined depending on the angle θ of the first region 211 similarly as in the First Embodiment. In this embodiment, smax (θ) is a length (height) of the groove 300 from the lowest point position of the bottom portion 301 to an upper-limit position of the first region 311 with respect to a depth direction of the groove 300.

Incidentally, θ of smax (θ) and smin (θ) is the angle of the side surface portion 310 at an associated position with respect to the normal Q.

Further, smin (θ) is a lower limit, of the region where the first region 311 is required, determined depending on the angle θ of the first region 311, and is a length (height) of the groove 300 from the lowest point position of the bottom portion 301 to a lower-limit position of the first region 311 with respect to the depth direction of the groove 300. In this embodiment, smin (θ)=r/2(1−sin θ) is satisfied. When at least a part of the first region 311 is formed in a region equal to or higher than the lower-limit position smin (θ), the carrier is contactable to the first region 311.

For example, in the case where θ is 30°, the lower limit of the first region 311 is r/4. For this reason, when the first region 311 is formed at a position equal to or higher than r/4, the phantom circle C and the first region 311 can contact each other. As a result, at least one carrier particle is contactable to the first region 311. As a result, it is possible to enhance a feeding property of at least one carrier particle.

On the other hand, the upper limit smax (θ) of the first region 311 satisfies: smax (θ)=r+r/2(1−sin θ). That is, the first region 311 is formed at a position lower than the upper-limit position smax (θ). For example, in the case where θ is 30°, the first region 311 satisfies: smax (30°)=5r/4. That is, in the case where the angle θ of the first region 311 is θ=30°, the first region 311 may only be required to be set at a position lower than 5r/4. Thus, even when the carrier in a second layer enters the groove 300, the carrier in the second layer can be made hardly contactable to the first region 311. For this reason, the carrier in the second layer can be made to hardly be caught by the groove 300, so that it is possible to promote replacement of the carrier.

From the above, the first region 311 is constituted so as to be formed at least in a region from the lowest point position of the bottom portion 301 to a position equal to or higher than r/2(1−sin θ) with respect to the depth direction of the groove 300. In addition, the first region 211 is constituted so as not to be formed in a region where the height from the lowest point position of the bottom portion 301 is equal to or higher than r+r/2(1−sin θ).

Here, in the cross-section perpendicular to the rotational axis direction of the developing sleeve 103A, an interval between the pair of side surface portions 310 at a position of a height of r/2 from the lowest point position of the bottom portion 301 is X.

That is, at a downstream side surface portion 310 with respect to the rotational direction of the developing sleeve 103A, the position of the height of r/2 from the lowest point position of the bottom portion 301 is A1. Further, at the upstream side surface portion 210 with respect to the rotational direction of the developing sleeve 103A, the position of the height of r/2 from the lowest point position of the bottom portion 301 is C1.

Further, a width of a line connecting A1 and C1 with respect to the circumferential direction of the developing sleeve 103A, i.e., the interval between the pair of side surface portions 310 at the positions A1 and C1, is X. In this case, the interval X is made larger than the volume-average particle size r of the carrier (X>r). Further, the interval X is 60 μm. Further, in this embodiment, the angle A1 formed between the side surface portion 310 and the normal Q at the position A1 (C1) is 35°.

Further, in the case where a length of the second region 312 from the opening 302 with respect to the depth direction is s2, the relationship of s×0.1≤s2 is satisfied. In a preferred example, the second region 312 is the relationship of s2≤s×0.5 is satisfied. In this embodiment, a region of 5 μm from the line γ connecting both ends of the opening 202 (s2=5 μm). That is, an end position of the second region 312 of the downstream side surface portion 310 with respect to the rotational direction of the developing sleeve 103A in the bottom portion 301 side is A2, and an end position of the second region 312 of the upstream side surface portion 310 with respect to the rotational direction of the developing sleeve 103A in the bottom portion 301 side is C2. In this case, the distance s2 between the line γ and a line connecting A2 and C2 is 5 μm. Further, in this embodiment, the angle Θ2 formed between the normal Q and the side surface portion 310 at each of the positions A2 and C2 is 55°.

[Groove Width at Upper End Portion of First Region]

In this embodiment, similarly as in the First Embodiment, the following relationship is satisfied. That is, the groove width (with respect to the circumferential direction of the developing sleeve) at the upper end position of the first region is made larger than r and is made smaller than 2 r. As a result, the number of carriers (carrier particles) carried and fed between the first regions closely relating to the feeding property can be made one (particle) at the most with respect to the circumferential direction of the developing sleeve.

[Depth of First Region (Upper End Height of First Region]

In this embodiment, similarly as in the First Embodiment, the following relationship is satisfied. That is, the first region is constituted so as to satisfy: (upper end height of first region) <r+r/2(1−sinθ). As a result, in the first region where the carrier is readily caught by the groove, only the carrier in the lowermost layer can exist. For this reason, it is possible to suppress an excessive increase in feeding property per (one) groove.

As described above, in this embodiment, the groove 300 of the developing sleeve is shaped so that the bottom portion 301 has an arcuate shape and the carrier existing at the bottommost portion is prevented from having the point of contact with the groove 300 at the portion other than the bottommost portion. Further, the inclination angle θ of the side surface portion 310 is set to satisfy θ<45° in the first region 311 in the bottom portion 301 side and to satisfy 45°<θ in the second region 312 in the opening 302 side. As a result, it is possible to smoothly replace the developer existing in the groove 300 without lowering the developer feeding force. As a result, it is possible to provide the image forming apparatus capable of effecting stable image formation for a long term.

Further, in the case of this embodiment, similarly as in the First Embodiment, realization of both ensuring the developer feeding property and suppression of carrier deterioration can be inexpensively achieved without upsizing the developing sleeve as described above.

Incidentally, as the image forming apparatus in which the developing device in each of the above-described embodiments is incorporated, it is possible to use a copying machine, a printer, a facsimile machine, a multi-function machine having a plurality of functions of these machines, and the like.

According to the present invention, in the developing device including the developing sleeve on which surface a plurality of grooves are formed, the carrier in each of the grooves is easily replaced and thus it is possible to suppress the deterioration of the carrier while suppressing an excessive feeding force per (one) groove.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-171089 filed on Aug. 31, 2015, which is hereby incorporated by reference herein in its entirety.

What is claimed is:

1. A developing device comprising:

a developing container configured to accommodate a developer containing toner and carrier particles;

a cylindrical developing sleeve rotatable while carrying the developer in said developing container;

a magnet provided in said developing sleeve and configured to generate a magnetic force for holding the developer; and a plurality of grooves provided at a developer carrying surface of said developing sleeve and formed along a direction crossing a circumferential direction of said developing sleeve, wherein in a cross-section perpendicular to a rotational axis of said developing sleeve, each of said grooves is formed by a flat bottom portion contacting the carrier particle and a pair of side surface portions provided in both sides of said flat bottom portion with respect to the circumferential direction of said developing sleeve and satisfies the following relationships:

$$r<w<2r,$$

$$2\times r<L, \text{ and}$$

$$r/2\leq s<2r,$$

where r is a volume-average particle size of the carrier particles, w is a length of the flat bottom portion measured in the cross-section perpendicular to the rotational axis of said developing sleeve, L is a width between said side surface portions at the surface of said developing sleeve in the cross-section perpendicular to the rotational axis of said developing sleeve, and s is a depth of each of said grooves.

2. A developing device according to claim 1, wherein each of said side surface portions includes a region where an angle formed between a vertical line and a first surface portion of said side surface portion close to said bottom portion is less than 45° and a region where an angle formed between the vertical line and a second surface portion of said side surface portion, remoter from said bottom portion than said first surface portion is, is larger than 45°.

3. A developing device according to claim 2, wherein when the angle formed between the vertical line and the first surface portion of said side surface portion close to said bottom portion is θ, θ satisfies: $20°\leq\theta<45°$.

4. A developing device according to claim 2, wherein a height from a lowest point position of said bottom portion to an upper end position of said first surface portion is r/2 or more and less than 3r/2.

5. A developing device according to claim 1, wherein said pair of side surface portions is formed so as to be line symmetrical.

6. A developing device according to claim 1, wherein the following relationship is satisfied:

$$L<3\times r.$$

7. A developing device according to claim 1, wherein an average circularity of the carrier is 0.910 or more and 0.995 or less.

8. A developing device comprising:

a developing container configured to accommodate a developer containing toner and carrier particles;

a cylindrical developing sleeve rotatable while carrying the developer in said developing container; and a plurality of grooves provided at a developer carrying surface of said developing sleeve and formed along a direction crossing a circumferential direction of said developing sleeve, wherein in a cross-section perpendicular to a rotational axis of said developing sleeve, each of said grooves is formed by an arcuate bottom portion contacting the carrier particle and a pair of side surface portions provided in both sides of said arcuate bottom portion with respect to the circumferential direction of said developing sleeve and satisfies the following relationships:

$$r<w<2r,$$

$$2\times r<L, \text{ and}$$

$$r/2\leq s<2r,$$

where r is a volume-average particle size of the carrier particles, w is a length of a chord of the arcuate bottom portion measured in the cross-section perpendicular to the rotational axis of said developing sleeve, L is a width between said side surface portions at the surface of said developing sleeve in the cross-section perpendicular to the rotational axis of said developing sleeve, and s is a depth of each of said grooves.

9. A developing device according to claim 8, wherein each of said side surface portions includes a region where an angle formed between a vertical line and a first surface portion of said side surface portion close to said bottom portion is less than 45° and a region where an angle formed between the vertical line and a second surface portion of said side surface portion, remoter from said bottom portion than said first surface portion is, is larger than 45°.

10. A developing device according to claim 9, wherein when the angle formed between the vertical line and the first surface portion of said side surface portion close to said bottom portion is θ, θ satisfies: $20°\leq\theta<45°$.

11. A developing device according to claim 9, wherein a height from a lowest point position of said bottom portion to an upper end position of said first surface portion is r/2 or more and less than 3r/2.

12. A developing device according to claim 8, wherein said pair of side surface portions is formed so as to be line symmetrical.

13. A developing device according to claim 8, wherein the following relationship is satisfied:

$$L<3\times r.$$

14. A developing device according to claim 8, wherein an average circularity of the carrier is 0.910 or more and 0.995 or less.

15. A developing device comprising:

a developing container configured to accommodate a developer containing toner and carrier particles;

a cylindrical developing sleeve rotatable while carrying the developer in said developing container;

a magnet provided in said developing sleeve and configured to generate a magnetic force for holding the developer; and a plurality of grooves provided at a developer carrying surface of said developing sleeve and formed along a direction crossing a circumferential direction of said developing sleeve, wherein each of said grooves is formed by a bottom portion contacting the carrier and a pair of side surface portions provided in both sides of the bottom portion with respect to a circumferential direction of said developing sleeve, and wherein in a cross-section perpendicular to the bottom portion, said side surface portions and a rotational axis of said developing sleeve, each of said grooves is disposed so that one particle of the carrier particles with an average particle size cannot contact said side surface portions simultaneously when the one particle of the carrier particles contacts said bottom portion and so that two particles of the carrier particles with the average particle size cannot contact said bottom portion simultaneously and satisfies the following relationships:

$$2\times r<L, \text{ and}$$

$$r/2\leq s<2r,$$

where r is a volume-average particle size of the carrier particles, L is a width between said side surface portions at the surface of said developing sleeve in the cross-section perpendicular to the rotational axis of said developing sleeve, and s is a depth of each of said grooves.

16. A developing device according to claim 15, wherein said bottom portion has a flat shape.

17. A developing device according to claim 15, wherein said bottom portion has an arcuate shape.

18. A developing device according to claim 15, wherein each of said side surface portions includes a region where an angle formed between a vertical line and a first surface portion of said side surface portion close to said bottom portion is less than 45° and a region where an angle formed between the vertical line and a second surface portion of said side surface portion, remoter from said bottom portion than said first surface portion is, is larger than 45°.

19. A developing device according to claim 18, wherein a height from a lowest point position of said bottom portion to an upper end position of said first surface portion is r/2 or more and less than 3r/2.

20. A developing device according to claim 15, wherein said pair of side surface portions is formed so as to be line symmetrical.

21. A developing device according to claim 15, wherein when the angle formed between the vertical line and the first surface portion of said side surface portion close to said bottom portion is θ, θ satisfies: $20°\leq\theta<45°$.

22. A developing device according to claim 15, wherein the following relationship is satisfied:

$$L<3\times r.$$

23. A developing device according to claim 15, wherein an average circularity of the carrier is 0.910 or more and 0.995 or less.

* * * * *